US006340293B1

(12) United States Patent
Bona et al.

(10) Patent No.: US 6,340,293 B1
(45) Date of Patent: Jan. 22, 2002

(54) CLUTCHLESS COMPRESSOR CONTROL VALVE WITH INTEGRAL BY PASS FEATURE

(75) Inventors: Joseph M. Bona, Williamsville; Michael Jay Burkett, Sanborn; Theodore R. Cochran, Amherst, all of NY (US)

(73) Assignee: Delphi Technologies INC, Troy, MI (US)

( * ) Notice: Subject to any disclaimer, the term of this patent is extended or adjusted under 35 U.S.C. 154(b) by 0 days.

(21) Appl. No.: 09/650,096

(22) Filed: Aug. 25, 2000

(51) Int. Cl.[7] ..... F04B 49/24
(52) U.S. Cl. ..... 417/307; 417/222.2
(58) Field of Search ..... 417/213, 222.2, 417/307

(56) References Cited

U.S. PATENT DOCUMENTS 4,251,193 A * 2/1981 Minnis et al. ..... 417/307
4,428,718 A 1/1984 Skinner
4,526,516 A 7/1985 Swain et al.
4,606,705 A 8/1986 Parekh
5,071,321 A 12/1991 Skinner et al.
5,584,670 A 12/1996 Kawaguchi et al.
6,010,312 A * 1/2000 Suitou et al. ..... 417/222.2
6,038,871 A 3/2000 Gutierrez et al.
6,200,105 B1 * 3/2001 Kawaguchi et al. ..... 417/222.2

* cited by examiner

*Primary Examiner*—Michael Koczo
(74) *Attorney, Agent, or Firm*—Patrick M. Griffin

(57) ABSTRACT

A capacity control valve (17) for use in a clutchless, variable capacity compressor includes a central rod plunger (34) that is shifted axially in one direction, against a spring (39), by an energized coil (40), when the compressor is in a greater than minimum capacity condition. For the minimum capacity position, the rod plunger (34) is released by the de energized coil (40) to be pushed by spring (39) in the opposite direction to a solid, pre determined position. A by pass passage (42) interconnecting a discharge pressure chamber (20) and a suction pressure chamber (26) runs in parallel to the rod plunger (34), normally closed off by its own spring loaded shut off valve (44). When the coil 40 is de energized to release the plunger (34), it engages the shut off valve, opening the by pass passage and opening the discharge pressure chamber (20 to the suction pressure chamber (26). This creates a refrigerant recirculation path, internal to the valve (17), for the small refrigerant flow that is still pumped by the compressor at minimum stroke.

4 Claims, 4 Drawing Sheets

CLUTCHLESS COMPRESSOR CONTROL VALVE WITH INTEGRAL BY PASS FEATURE

TECHNICAL FIELD

This invention relates to clutchless type automotive air conditioning compressors, and specifically to a capacity control valve therefor which has a built in by pass feature that is operative during minimum compressor stroke.

BACKGROUND OF THE INVENTION

Automotive air conditioning compressors, whether of fixed or variable capacity, have typically interposed an electromagnetic clutch between the drive pulley and the compressor drive shaft, which allows the compressor to be entirely disconnected when air conditioning demand is absent or very low. This obviously saves on energy and compressor wear, and prevents evaporator icing that would otherwise occur when cooling demand was low and the compressor continued to pump. With a fixed capacity compressor, a clutch is the only practical way to bring the compressor pumping capacity to zero.

With a variable capacity compressor, however, there is the potential to eliminate the clutch, which is a fairly expensive component. Variable capacity piston compressors reduce or increase capacity by changing the piston stroke length which, in turn, is accomplished by changing the slant angle of the piston driving wobble plate relative to the rotating drive shaft. A greater slant increases stroke length, while a smaller, more nearly perpendicular angle minimizes stroke lenght. Changing the slant angle, in turn, is typically accomplished indirectly by changing the net pressure force balance seen by the front and back of the piston as the piston is pulling back within its bore. The wobble plate that drives the pistons through their stroke is pivoted and hinged to the drive shaft is such a way as to allow it to passively respond to that net pressure balance on the pistons, and to change its angle relative to the drive shaft, thereby accomodating itself to the stroke that piston follows based on the pressure balance that acts on it. This slant angle of the wobble plate changes in such a way as to keep the forwardmost or "top dead center" stroke position of the piston consistent.

The net pressure balance seen by the piston, in turn, is the difference between the suction cavity pressure, which acts on front of the piston, the crankcase pressure, which acts on the rear of the piston, behind the cylinder bores. When the piston front (suction) pressure is relatively greater than the piston rear (crankcase) pressure, the piston can retract farther in its backstroke. This pressure balance can be controlled by suitable valves that admit some of the discharge cavity pressure into, or vent it from, the crankcase, in response to suction pressure (which is a function of cooling demand), discharge pressure, or both. Such a control valve can be seen in co assigned U.S. Pat. No. 4,428,718 to Skinner, which discloses a passively acting valve. Such valves can also be directly, actively controlled, such as by an electronic solenoid mechanism, as disclosed in co assigned U.S. Pat. No. 6,038,871 to Gutierrez et al. With electronic control, there is the potential to operate the valve in response to a multitude of possible vehicle and engine parameters. Valves of this basic design are oriented in the compressor rear head, with a small diameter plunger that shifts up and down to solidly open or close various ports in the stationary valve body, so as to open or close various flow paths between and among the suction, discharge and crankcase cavities.

A different valve design is the so called spool valve, which incorporates a large diameter slidable cylindrical member or spool located at the center of the compressor housing, coaxial to the compressor drive shaft. A the spool is shifted back and forth, typically with a solenoid, various grooves and ports in the spool into or out of line with flow passages in the compressor housing. This also makes or breaks various flow path connections between and among the discharge, suction and crankcase cavities to effect the pressure balance on the pistons and the consequent piston stroke. An inherent drawback of spool valves is that a large sliding surface area between the spool and its sliding bore must be held in sufficiently close contact to provide a fluid seal. Also, the location of spool valves, concentric to the compressor drive shaft, inevitably adds a significant extra axial length to the compressor housing. Plunger type valves, by contrast, with their relatively narrow central rods, are more compact, have less mutually contacting sliding surface area, and provide a solid, on off action.

With electronically operated capacity control valves of either the spool or plunger type, there exists the potential for eliminating the clutch, since it is possible to bring the piston stroke almost to zero (by bringing the wobble plate angle nearly to ninety degrees, or no slant). However, it is not practical to bring the piston drive plate absolutely to ninety degrees, so that minimum piston stroke is a small, but still greater than zero, stroke, which causes some refrigerant pumping to occur. In low demand situations, this can potentially cause evaporator freezing, over time.

Electronically controlled variable capacity piston compressors using centrally located spool valves have dealt with the minimum stroke, evaporator freezing problem with at least two known methods. Each known method involves cutting the compressor flow off from the overall system, and providing instead an internal recirculation path within the crankcase housing to accommodate the refrigerant that the compressor continues to attempt to pump at minimum stroke.

One relatively old method, disclosed in U.S. Pat. No. 4,526,516, cuts the compressor flow through the system, at minimum stroke, by a spring biased check valve which simply shuts when the discharge pressure is low, as it is at minimum stroke. At the same time, with the solenoid deenergized, a feed back spring pulls the spool valve into a position which aligns various grooves and ports on the spool so as to establish a three way path between and among suction, crankcase and discharge to allow the pumped refrigerant to recirculate. This design requires the spring to accurately pull the spool into the position that establishes the recirculation path, a position that is dependent upon consistent spring operation, without a solid stop.

A newer design, disclosed in U.S. Pat. No. 5,584,670, provides a moving spool that cuts off flow to the suction cavity, rather than to discharge. As the spool moves to cut off suction flow, it also establishes a similar recirculation path between and among the crankcase, suction and discharge. The flow path is complex, using several dedicated passages in the compressor housing, and the overall system requires a plunger type valve in the rear head, as well as the spool, making it particularly non compact.

SUMMARY OF THE INVENTION

The subject invention provides a freeze protection feature for a clutchless, variable capacity piston compressor using a plunger type control valve, in which a refrigerant by pass path, directly from discharge to suction, is provided integrally within the valve itself.

In the preferred embodiment disclosed, the compressor housing rear head contains a plunger type capacity control valve of a known type in which a central rod or plunger is shifted up and down by a solenoid to selectively open and close a flow path from discharge, into the valve, and then to crankcase, thereby controlling the back pressure in the crankcase, to thereby control the effective piston stroke. There is, therefore, an existing discharge opening into the valve body. The disclosed valve is also the type that has a suction pressure responsive means to change the effective length of the plunger rod, and thereby change the effective opening of the discharge to crankcase flow path. This suction pressure responsive means is an evacuated bellows that resides in a chamber open to suction. While the bellows chamber is essentially static, that is, open to suction pressure, but with no substantial flow in or out, it does have an existing suction opening into the valve body.

The improvement of the invention makes use of the already existing discharge and suction ports to the valve body, and also of the pre existing motion of the plunger, to create a pumped refrigerant by pass path that acts only at minimum stroke, which is entirely integral and internal to the valve body, and which is solidly shut off at all times other than during minimum stroke operation. A secondary, passively acting, spring loaded by pass valve is provided through the valve body, between the discharge and suction ports, in parallel to the central plunger. The by pass valve is solidly shut off at all positions of the plunger corresponding to other than minimum stroke. When the plunger is fully pushed down, and minimum stroke, to fully open the discharge to crankcase flow path, it also pushes down and opens the by pass valve. A direct by pass path is thereby established between discharge and suction to re circulate the refrigerant flow an the minimum stroke position. The by pass path is inoperative at all other times. No changes to the compressor housing, and only minor changes to the valve body, are required.

BRIEF DESCRIPTION OF THE DRAWINGS

These and other features of the invention will appear from the following written description, and from the drawings, in which.

DESCRIPTION OF THE PREFERRED EMBODIMENT

Figure 1:
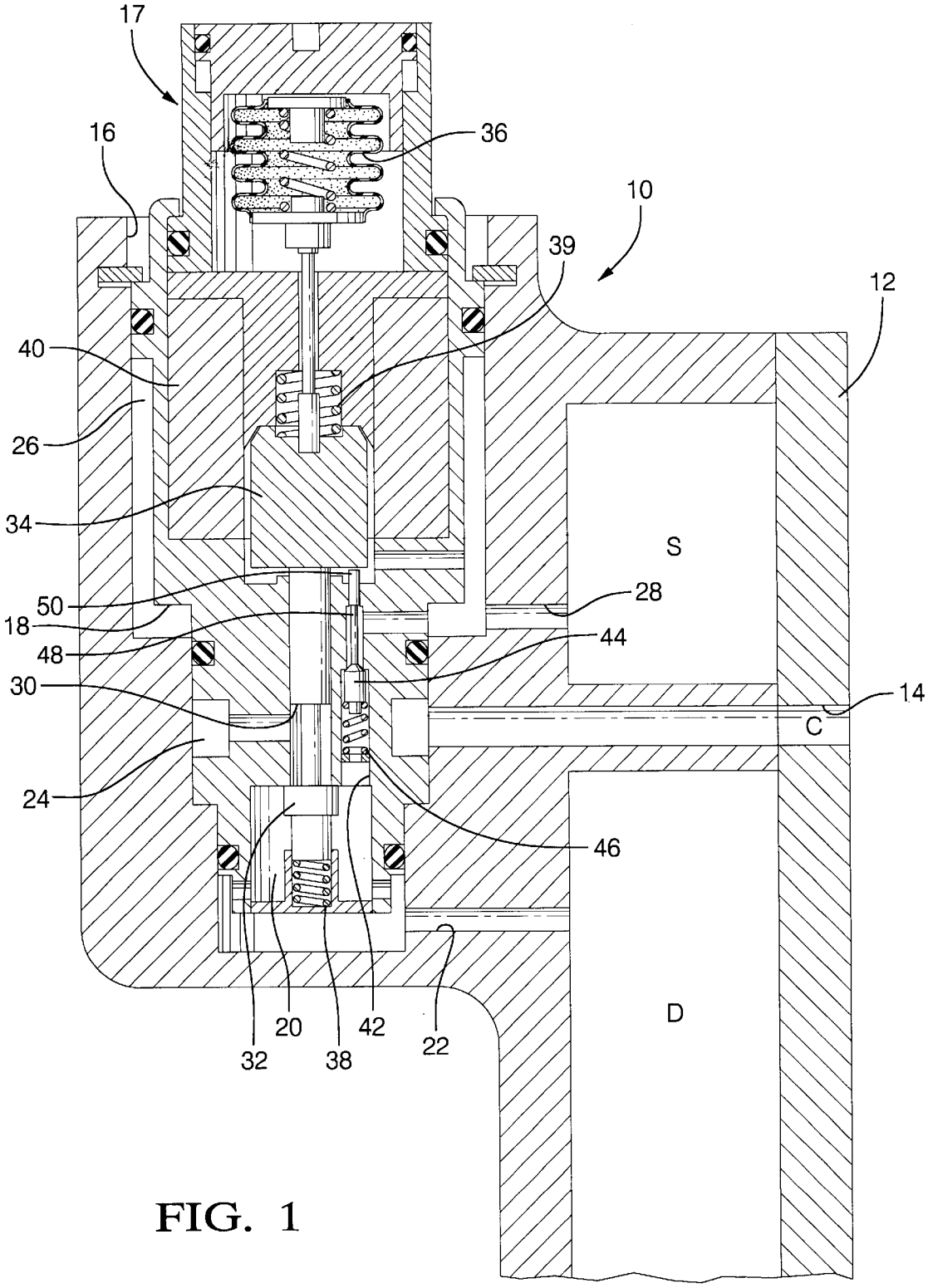
FIG. 1 is a cross sectional view of a valve according to the invention, and part of a compressor rear head and housing incorporating the valve, showing the control valve in a maximum stroke position, with the by pass valve closed.

Referring first to FIG. 1, part of a generally cylindrical compressor housing rear head, indicated generally at 10. Rear head 10 has formed therein an integral suction cavity S and discharge cavity D, each separated from a crankcase cavity C by a standard valve plate 12. A conventional, non illustrated cylinder block is to the right of valve plate 12 . The crankcase cavity C is that volume of the compressor housing located behind non illustrated cylinder bores and pistons, and is sealed, but for a crankcase passage 14 in the rear head 10 that opens through valve plate 12 and to another area of rear head 10, described below. Valve plate 12 would also include conventional one way reed valves designed to allow flow out of suction cavity S and into the cylinder bores, and out of the cylinder bores into the discharge cavity D.

Figure 2:
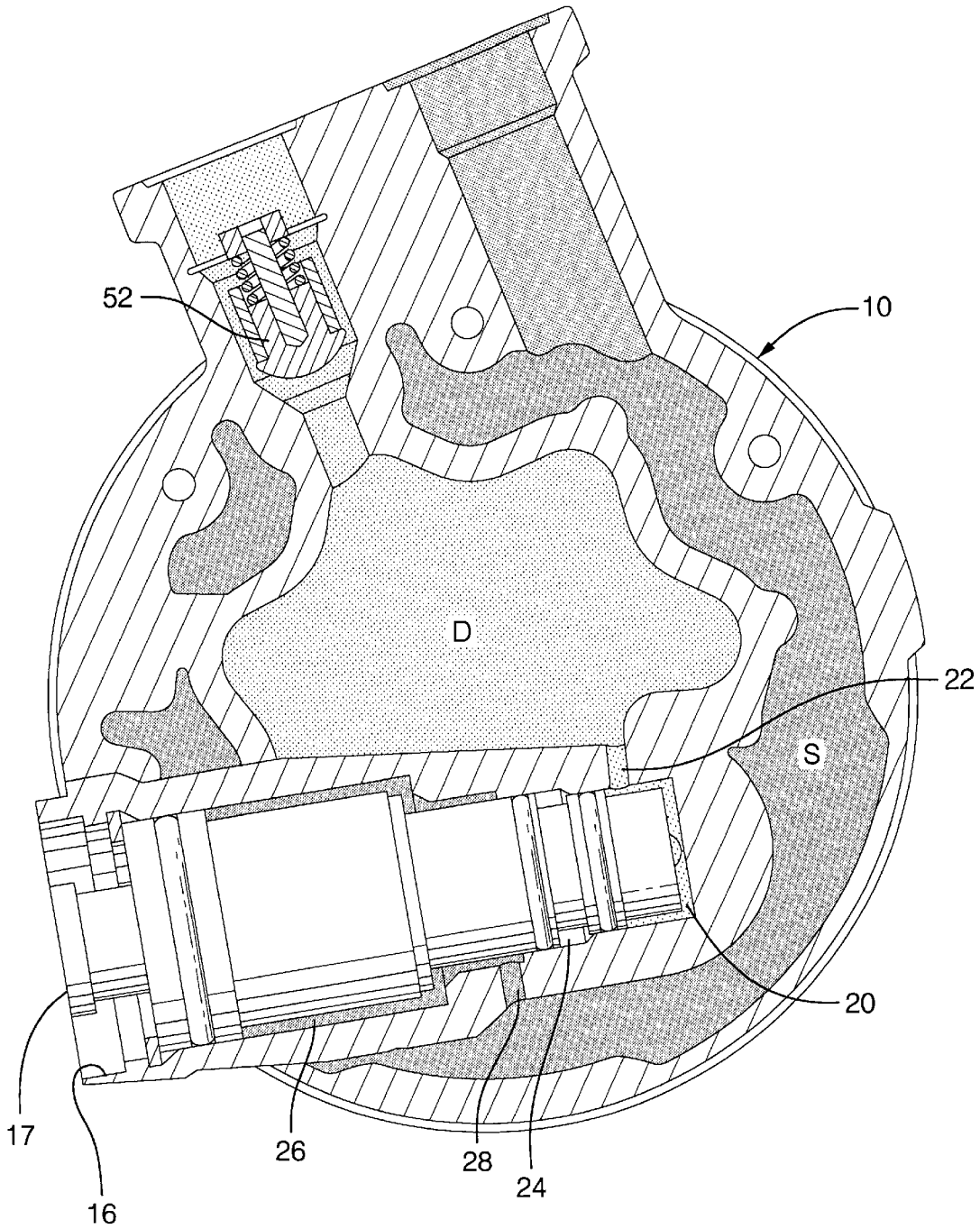
FIG. 2 is a schematic end view of the compressor, showing the valve in elevation, and illustrating the flow in the discharge and suction cavities corresponding to the valve position of FIG. 1

Referring next to FIGS. 1 and 2, rear head 10 is formed with a stepped diameter bore 16, which is oriented generally perpendicular to the central axis of rear head 10, and which is long enough to cross both the suction and discharge cavities S and D. Bore 16 is relatively longer than it is wide, and therefore does not add a great deal of extra axial thickness to rear head 10. Inserted within bore 16 is a capacity control valve, indicated generally at 17, which has a stationary valve body 18 that supports and contains several other structures, and which also divides bore 16 up into several separate, discretely sealed chambers. At the bottom, a discharge pressure chamber 20 opens into discharge cavity D through a discharge port 22. At the center, a crankcase chamber 24 opens into crankcase cavity C through the crankcase passage 14. At the top, a suction chamber 26 opens into suction cavity S through a suction port 28. Significantly, all of these chambers and ports exist already in this type of valve. The valve body 18 supports a central rod, indicated generally at 30, which has a discharge stopper 32 at the bottom (within the discharge chamber 20), a plunger 34 near the center, and an evacuated bellows 36 at the top (within the suction chamber 26). Above stopper 32, rod 30 is narrowed to allow a flow connection between discharge chamber 20 and crankcase chamber 24. A lower spring 38 biases rod 30 upwardly, and a stronger central spring 39 biases rod 30 downwardly. The rod plunger 34 is surrounded by a solenoid coil 40 which, when energized, pulls up on the plunger 34 in proportion to the current in the coil, pulling it up far enough to shut off the connection between the discharge chamber 20 and crankcase chamber 24 when fully energized, as shown in FIG. 1. When coil 40 has less (but still more than 0) current, plunger 34 is stilled pulled upwardly, but less so, and, when coil 40 is totally deenergized, it releases plunger 34 to move all the way down to a predetermined position, described in more detail below. The structure described thus far is typical for this kind of valve 17, and the improvement of the invention, described next, works with this pre existing structure and pre determined operation.

Still referring to FIGS. 1 and 2, adjacent and parallel to central rod 30 is a by pass passage 42 that runs through valve body 18. Within by pass passage 42, a shut off valve, indicated generally at 44 is normally pushed up by a spring 46. Spring 46 is significantly less strong than upper plunger spring 39, but is strong enough to solidly close off the by pass passage 42. The intermediate portion 48 of valve 44 is reduced in diameter, relative to by pass passage 42, while the top 50 thereof extend up far enough to rest below the plunger 34. Valve 44 is thus always closed, except at the minimum stroke condition, further described below. Conversely, a spring loaded check valve 52 resides within rear head 10 at the outlet of discharge cavity D, the shut off spring force of which is set to be always open at those discharge pressures expected for all conditions, except the minimum stroke condition.

Still referring to FIGS. 1 and 2, the general operation of the capacity control valve 17, apart from the shut off valve 44, is described. When it is desired to run the compressor at some stroke greater than the minimum, the coil 40 is energized with a current ranging, for example, from 0 to 1 amp. The current, in turn, can be made a function of numerous sensed vehicle parameters, such as ambient temperature, evaporator temperature, cabin temperature, etc. The greater the current, the greater the upward pull asserted on the plunger 34, and the closer the discharge stopper 32 is pulled toward the completely closed position shown in FIG. 1. At the completely closed position, there will be no pressurizing flow from the discharge cavity to crankcase cavity C, and the piston stroke will be maximized. For partially closed positions of the discharge stopper 32, there will be proportionately more pressurizing flow, and proportionately less resultant piston stroke. The degree of stopper 32 opening is also affected by the effective length of rod 30 which, in turn, is affected by the bellows 36 noted above. As the pressure within suction pressure chamber 26 falls (which it does with decreasing cooling demand), bellows 36 will expand, causing rod 30 to lengthen, and causing discharge stopper 32 to be more open. The position of rod 30, for any positive stroke, will therefore be an equilibrium resulting from the current in coil 40, the countervailing forces of the springs 38 and 39, and the length of bellows 36. The effect of bellows 36 is not directly relevant to the subject invention, apart from the fact that its presence requires the existing suction pressure chamber 26. What is most significant is that for all positions of the rod 30 corresponding to any greater than minimum piston stroke, the top 50 of shut off valve 44 will remain untouched by the rod plunger 34, and will thus remain solidly closed by its spring 46. The only flow into the suction chamber 26 will therefore be that small inflow and outflow from the suction cavity S that results from the change in suction pressure (and the resultant expansion and contraction of the bellows 36. At all greater than minimum stroke positions of the plunger 34, therefore, the suction chamber 26 remains no more than a suction sensing chamber, without appreciable flow into or through it, as it is in a conventional system that does not have the by pass passage 42 and shut off valve 44. This state is illustrated in FIG. 2, which shows that the refrigerant flow from discharge chamber D is, for all positive stroke conditions, out and past the check valve 52, not back into the suction chamber S.

Figure 3:
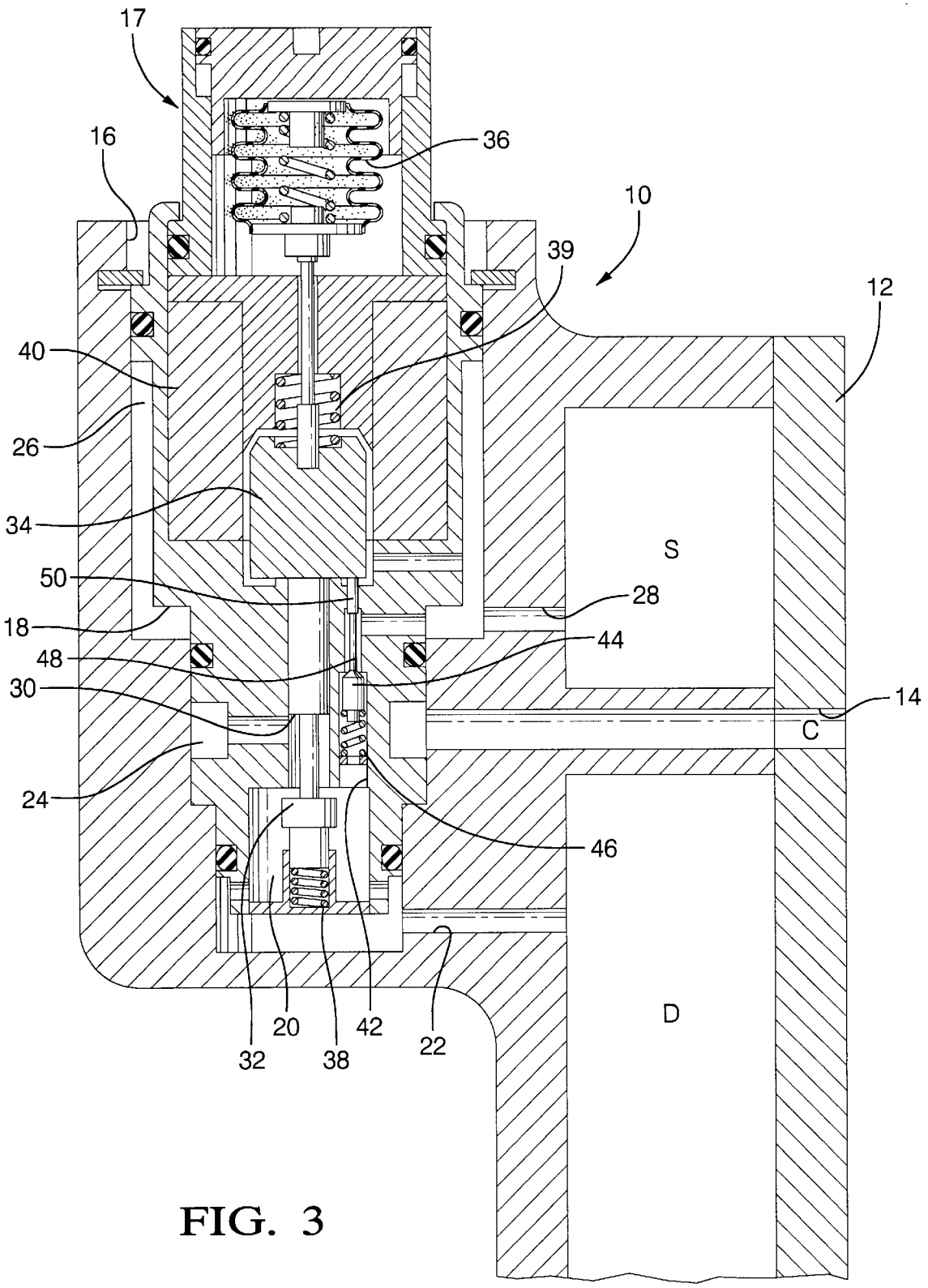
FIG. 3 is a view similar to FIG. 1, but showing the control valve in the minimum stroke position, with the by pass valve open.
Figure 4:
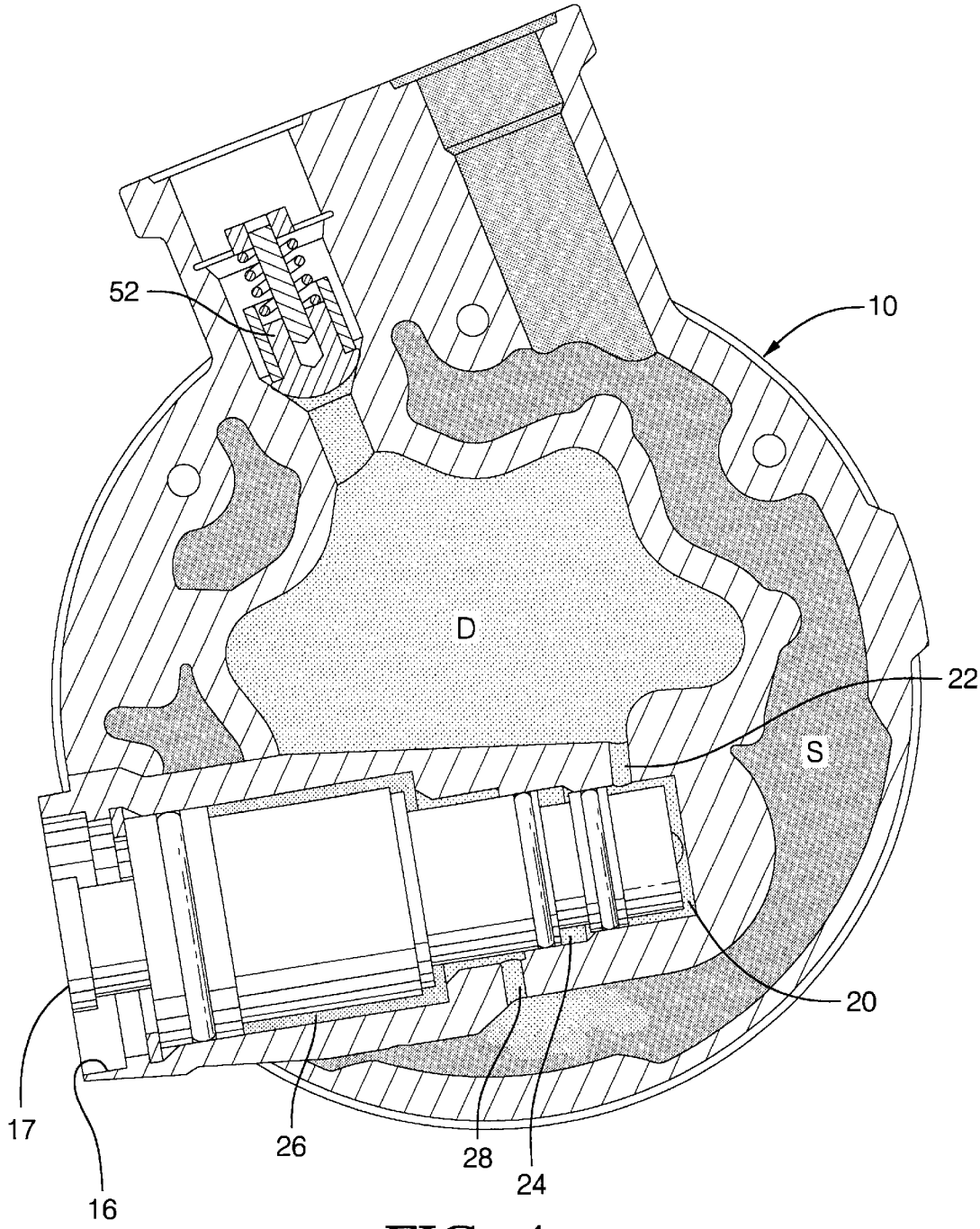
FIG. 4 is a view similar to FIG. 2, but showing the flow corresponding to the valve position of FIG. 3.

Referring next to FIGS. 3 and 4, the operation of the shut off valve 44 is illustrated. When minimum piston stroke is desired, based on the sensed parameters, the coil 40 is totally de energized, allowing the stronger upper spring 39 to push the plunger 34 forcibly down to a predetermined position solidly engaged with the bottom of the crankcase pressure chamber 24 within valve body 18. The discharge stopper 32 is pushed downwardly and open to create the greatest possible opening from the discharge cavity D, into discharge chamber 20, past stopper 32, into crank case pressure chamber 24 and ultimately through passage 14 into crankcase cavity C. This allows the crankcase cavity C to become maximally pressurized relative to (and above) the pressure in suction cavity S, creating a typical pressure differential of approximately 15 to 25 psi. This net pressure balance acting on the pistons, in turn, reduces their stroke to the minimum, and the absolute discharge pressure in discharge cavity D resulting from the minimum stroke is small enough to allow the check valve 52 to close off any flow out of the discharge cavity D. Therefore, there is no flow through the non illustrated evaporator, and no consequent freezing. It should be recalled that the suction pressure in cavity S will also be low, however, because of low cooling demand, so even with the pressure in crankcase cavity C being comparable in pressure to the low discharge pressure at this time, it will still be relatively greater than the suction pressure, creating the back to front, stroke reducing pressure differential acting on the pistons.

Still referring to FIGS. 3 and 4, it will be recalled that the minimum piston stroke, while small, still creates a pumping action, and with the outlet from discharge cavity D closed by check valve 52, an alternative outlet for that small pumping action is needed. The downward motion of the plunger 34 referred to above that attends the minimum stroke condition also creates a solid contact between the bottom of plunger 34 and the top 50 of shut off valve 44, causing it to shift downward against its spring 46 bias. This opens the discharge pressure chamber 20 to the suction chamber 26, with flow occuring through the open coils of the spring 46, around the valve reduced diameter portion 48 through the by pass passage 42. This also opens the discharge cavity D to the suction chamber S. Now, the suction chamber S begins to serve a purpose other than just serving as a pressure sensing chamber, as it is at greater than minimum piston stroke conditions. The small, but positive pumped flow from the discharge cavity D can recirculate continually to the suction cavity S, as best illustrated in FIG. 2. While the discharge cavity D is also open to the crankcase cavity C, through the passage 14, flow from discharge cavity D into crankcase cavity C occurs fairly quickly during the stroke reduction period, and, thereafter, pumped flow out of the discharge cavity D is primarily through the by pass passage 42. The opening 14 into the crankcase cavity C, which already exists, is not an essential part of the refrigerant recirculation or by pass path, which instead is basically directly from D to S.

It is evident that the structure disclosed above is very compact, as compared to older, centrally located spool valve designs. It is also very easily retrofitted to existing valve designs, since the additional valve structure needed (only the by pass passage 42 and shut off valve 44) is entirely integral to the valve body 18, and requires no modification to existing passages or chambers in the rear head 10. For the system to work as a whole, of course, some means is necessary to cut off the low rate of pumped refrigerant flow to the evaporator which, in the embodiment disclosed, is the check valve 52. It is that cut off of flow, of course, which necessitates the provision of the by pass capability at all. The check valve 52 can also be easily added to the outlet of discharge cavity D. However, other means of flow cut off to the evaporator can be envisaged, and the subject invention is primarily concerned with the simple, compact by pass means added to the valve body 18, and only to the valve body 18, and the way in which it takes advantage of the pre existing features and operation of a valve like valve 17. Fundamentally, any capacity control valve that is contained within a compressor housing bore that has discrete, axially proximate discharge and suction chambers, and which has an axially movable rod means within the valve means that moves axially between predetermined, distinct positions when the compressor is in minimum stroke and non minimum stroke positions, can provide the parallel acting by pass passage and shut off valve, activated by that pre existing rod motion to connect and disconnect those pre existing discharge and suction chambers, all located entirely within the valve body and valve body containing bore in the compressor housing. This provides a maximum degree of simplicity and compactness, as well as ability to retro fit to existing designs.

What is claimed is:

1. A capacity control valve (17) for use in part of a compressor housing (10) having a valve containing bore (16) which contains a valve body (18) that divides said bore (16) into a discrete discharge pressure chamber (20) and a discrete suction pressure chamber (26), and in which an axially movable rod (30) moves back and forth within said valve body (18) between a predetermined minimum compressor capacity position and greater than minimum compressor capacity positions, characterized in that, said valve body (18) includes a by pass passage (42) connecting said discharge (20) and suction (26) chambers and, a shut off valve (44) within said by pass passage that is normally biased to a position closing said by pass passage (42), when said rod (30) is in any greater than minimum compressor capacity position, and which is engaged by said rod (30) to open said by pass passage (42) when said rod is in said predetermined minimum compressor capacity position.

2. A capacity control valve (17) according to claim 1, further characterized in that, said rod (30) is biased in one axial direction by a resilient means (39) and said shut off valve (44) is biased in the opposite axial direction by a weaker resilient means (46).

3. A capacity control valve (17) according to claim 1, further characterized in that, said rod (30) includes a plunger (34) that engages said shut off valve (44) to open said by pass passage (42).

4. A capacity control valve (17) according to claim 3, further characterized in that, said valve (17) includes a coil (40) that, when energized, pulls said plunger (34) in one axial direction for all greater than minimum capacity positions of said rod (30), and, when de energized, releases said plunger (34) to move in the opposite axial direction to engage said shut off valve (44) and open said by pass passage (42).

* * * * *